US009527632B2

(12) United States Patent
Wohlgenannt

(10) Patent No.: US 9,527,632 B2
(45) Date of Patent: Dec. 27, 2016

(54) PLASTIC CONTAINER HAVING A ROTARY CLOSURE

(71) Applicant: CAPARTIS AG, Schaffhausen (CH)

(72) Inventor: Herbert Wohlgenannt, Schaffhausen (CH)

(73) Assignee: CAPARTIS AG, Schaffhausen (CH)

( * ) Notice: Subject to any disclaimer, the term of this patent is extended or adjusted under 35 U.S.C. 154(b) by 0 days.

(21) Appl. No.: 14/904,093

(22) PCT Filed: Jun. 10, 2014

(86) PCT No.: PCT/IB2014/062102
§ 371 (c)(1),
(2) Date: Jan. 9, 2016

(87) PCT Pub. No.: WO2015/004547
PCT Pub. Date: Jan. 15, 2015

(65) Prior Publication Data

US 2016/0152385 A1 Jun. 2, 2016

(30) Foreign Application Priority Data

Jul. 10, 2013 (CH) ..... 1237/13

(51) Int. Cl.
*B65D 41/04* (2006.01)
*B65D 47/26* (2006.01)
*B65D 1/02* (2006.01)

(52) U.S. Cl.
CPC ..... *B65D 41/0428* (2013.01); *B65D 1/023* (2013.01); *B65D 47/263* (2013.01)

(58) Field of Classification Search
CPC ..... B65D 1/023; B65D 41/0428
(Continued)

(56) References Cited

U.S. PATENT DOCUMENTS 3,258,179 A 6/1966 Cherba
3,342,385 A 9/1967 Knight
(Continued)

FOREIGN PATENT DOCUMENTS

FR 2567106 1/1986
WO 2007009888 1/2007

OTHER PUBLICATIONS

International Search Report for PCT/IB2014/062102, English Translation attached to original, Both Completed by the European Patent Office on Aug. 27, 2014, All together 5 Pages.
(Continued)

*Primary Examiner* — Anthony Stashick
*Assistant Examiner* — Raven Collins
(74) *Attorney, Agent, or Firm* — Brooks Kushman P.C.

(57) ABSTRACT

A plastic container that is produced by an extrusion process or a PET blowing process having an associated rotary closure, which can be brought from a closed position to an open position by a pivoting movement. The neck of the container and the rotary closure are each made of only a single part. The container has a straight or slightly conical neck, which forms a radially protruding collar on the outside in the bottom half of the neck, on a lower edge of which collar an attachable rotary closure having snapping elements that can be locked, such that the rotary closure is retained on the neck so that the rotary closure can be pivoted about an axis of rotation of the rotary closure.

11 Claims, 3 Drawing Sheets

(58) Field of Classification Search
USPC ..... 222/111, 553, 566; 215/45
See application file for complete search history.

(56) References Cited

U.S. PATENT DOCUMENTS

| | | | | |
|---|---|---|---|---|
| 4,961,515 | A | 10/1990 | Schreiber | |
| 7,775,400 | B2 | 8/2010 | Wohlgenannt et al. | |
| 2006/0201970 | A1 * | 9/2006 | Jasek | B65D 83/205 222/153.11 |
| 2014/0252034 | A1 * | 9/2014 | Brannon | B65D 47/40 222/111 |

OTHER PUBLICATIONS

Switzerland Search Report for Swiss Application No. CH 01237/13, Completed by the European Patent Office on Jan. 15, 2014, 6 Pages.

* cited by examiner

PLASTIC CONTAINER HAVING A ROTARY CLOSURE

CROSS-REFERENCE TO RELATED APPLICATION

This application is the U.S. national phase of PCT Application No. PCT/IB2014/062102 filed on Jun. 10, 2014, which claims priority to CH Patent Application No. 01237/13 filed on Jul. 10, 2013, the disclosures of which are incorporated in their entirety by reference herein.

This invention concerns a plastic container, which is produced either by an extrusion process or by means of a PET blow-molding process or by means of plastic injection molding, and which is fitted with a rotary closure, so that the latter can be brought into an open position from the closed position by simple turning by a certain angle. In the open position, liquid can be poured out of the container directly through the rotary closure.

Containers produced by an extrusion process or by means of a PET blow-molding process or by plastic injection molding are known. Similarly known are rotary closures that can be brought into an open position from a closed position by simple turning by a certain angle. Reference is made in this respect for example to WO2007/009888. However, such rotary closures have so far always been produced from a number of parts and require an assembly operation for putting these parts together, which makes these closures much more expensive, for instance in comparison with a simple rotary closure cap.

The object of the present invention is therefore to provide a plastic container, produced either by an extrusion process, by means of a PET blow-molding process or by plastic injection molding, which is fitted with an associated rotary closure that can be brought into an open position from a closed position by a turning or pivoting, and which consists of a minimal number of parts, is easy to assemble and in the closed position provides a reliable seal, is as inexpensive as possible to produce and, finally, is extremely simple and foolproof to operate and thereby offers maximum operating convenience.

This object is achieved by a plastic container, produced either by an extrusion process, by means of a PET blow-molding process or a plastic injection-molding process, with an associated rotary closure that can be brought into an open position from a closed position by a pivoting, and which is distinguished by the fact that the container has a neck, which is straight or converges on its inner side conically or spherically in the direction of the container and forms on the outside in its lower half a radially protruding collar, on the lower periphery of which an attachable rotary closure can be locked in by snapping elements, so that said rotary closure is held on the neck pivotably about its axis of rotation, wherein the collar also forms radial surfaces, which act as stop surfaces for radial ribs on the inner side of the associated rotary closure for limiting the pivoting range between the closed position and the open position of the rotary closure on the neck, also that the mouth of the neck forms an end face, into which there leads a channel that is formed on the neck inner side, bulges out from the neck in the radial direction and is open toward the inner side of the neck, and that the rotary closure has on the inner side of its lid surface at least one outer tube portion, and also coaxially thereto an inner, longer tube portion or a conically converging or convexly outwardly curved continuation, wherein the outer tube portion lies in a sealing manner on the end face when the rotary closure is attached, and the inner, longer tube portion or the conically converging or convexly outwardly curved continuation extends into the neck interior while lying in a sealing manner against the correspondingly formed neck inner wall and has at one location an aperture, and that between the outer tube portion and the inner tube portion, or between the outer tube portion and the conically converging or convexly outwardly curved continuation, there is at the location of the aperture a hole in the lid surface, so that the aperture can be brought over the location of the bulging channel for the open position, so that liquid can flow through the aperture and the hole to the outside, whereas in the closed position the inner tube portion or the conically converging or convexly outwardly curved continuation covers over the bulging channel in the neck in a sealing manner.

This container and the associated rotary closure are represented in the drawings and the individual parts are described below and their function is explained on the basis of these drawings, in which.

Figure 1:
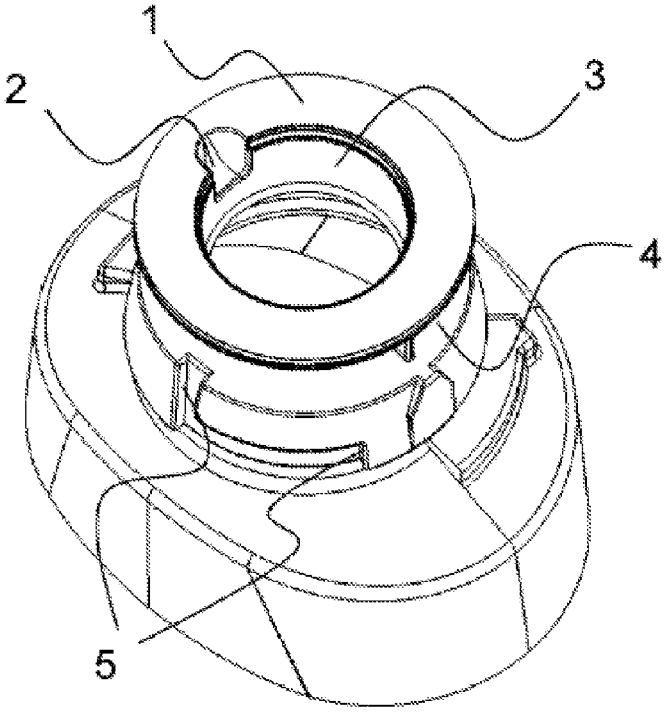
FIG. 1 shows a plastic container produced by an extrusion process or by means of a PET blow-molding process or plastic injection molding, seen obliquely from above.

In FIG. 1, a container produced either by an extrusion process or by means of a PET blow-molding process or by means of plastic injection molding is represented. It is seen here seen obliquely from above. It is a bottle, as used for instance for shampoos, though other contents also come into consideration, whether liquids or creams that are not too viscous, for instance sunscreen lotion or similar products from the food and non-food sector. The material of this container or this bottle may have a milky color, is in this case therefore translucent, but only to a very limited extent, just enough for the filling level of the liquid contained therein still to be discernible. As a special feature, the neck of this container or this bottle is designed in a quite specific way, which is essential for the reception and function of the rotary closure. By means of a snapping mechanism, the rotary closure can be attached to this neck by pressing and, once attached, the rotary closure seals off the neck and is nevertheless pivotable on the same in the horizontal plane, from a closed position into an open position, as already known per se from earlier rotary closures. However, these conventional rotary closures are always made up of a number of parts, at least two parts, sometimes even three or more parts, which necessitates a complex assembly operation and makes such solutions costly.

The special feature of the solution presented here is that the container on the one hand and the associated rotary closure on the other hand each form a single part, so that therefore only two single parts have to be produced and assembled. In order for this to be possible, the neck of the container must have a form as shown here. The neck 3 of the container in the example shown is cylindrically formed. As an alternative, it may also be formed as very slightly diverging conically upward, or else be spherically formed, with surfaces that are concave toward the interior of the neck and converge toward one another in the direction of the container. In its lower half, it in any event forms on the outside a radially protruding collar 4, on the lower periphery of which an attachable associated rotary closure can be locked in by snapping elements, so that said rotary closure is held on the neck 3 pivotably about its axis of rotation in a horizontal plane. The collar 4 also forms radial surfaces 5, which act as stop surfaces for radial ribs on the inner side of the associated rotary closure. They serve for limiting the pivoting range between the closed position and the open position of the rotary closure on the neck 3. In the example shown, the mouth of the neck 3 forms a projecting, circular-ring-shaped, planar end face 1, which acts as a sealing surface and sliding surface for the rotary closure to be attached. Into this end face 1 there leads from the inside a channel 2 that bulges out from the neck 3 in the radial direction and is open toward the inner side of the neck 3.

Figure 2:
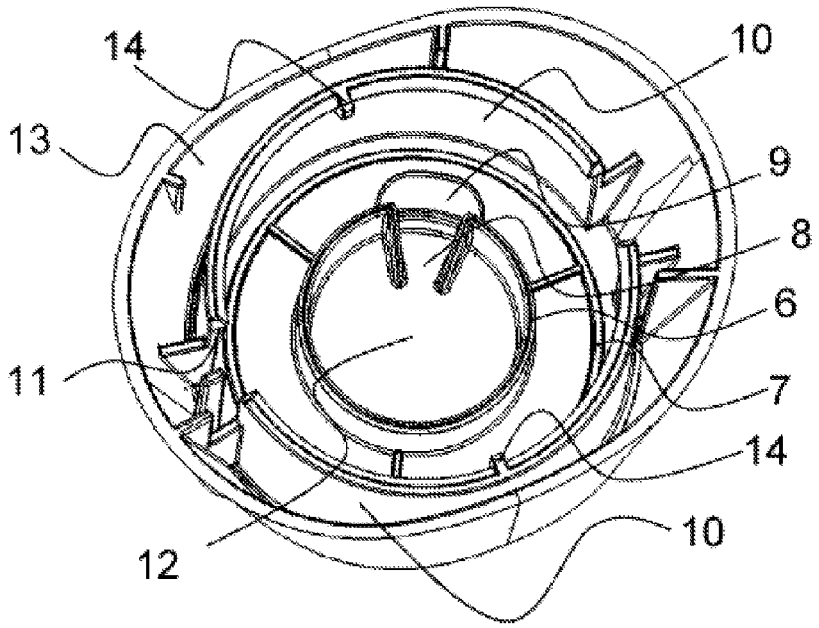
FIG. 2 shows the associated rotary closure in the inverted position, that is to say seen looking into its underside.

In FIG. 2, the associated rotary closure can be seen in the inverted position, that is to say shown looking into its underside. Integrally formed on the inner side of its lid surface 12 are two concentrically arranged, straight or slightly conical tube portions 6, 7, wherein the outer portion 7 lies in a sealing manner on the circular-ring-shaped end face 1 of the container neck 3 when the rotary closure is attached. The inner, longer tube portion 6 extends into the neck interior with an exact fit, and consequently while lying in a sealing manner along the cylindrical neck inner wall. If the neck is formed converging conically inward, taking the place of this longer tube portion 6 is a downwardly slightly conically converging tube, which then fits in a sealing manner onto the conical neck inner wall. In the case of a spherical neck inner surface, taking the place of the longer tube portion 6 is a continuation that is outwardly convexly curved all around and lies in a sealing manner on the concave inner wall of the neck when the rotary closure is attached. At a circumferential location of the longer tube portion, of the cone or of the convexly outwardly curved continuation, it has an aperture 8, here in the example therefore on the tube portion 6. Between the two tube portions 6, 7 there is at the location of the aperture 8 a hole 9 in the lid surface 12. With the rotary closure attached onto the neck 3, the aperture 8 can be pivoted over the location of the bulging channel 2, so that liquid can flow through the aperture 8 and the hole 9 to the outside. In the closed position, on the other hand, the inner tube portion 6 covers over the bulging channel 2 in the neck 3 in a sealing manner.

The container, produced either by an extrusion process, by means of a PET blow-molding process or by an injection-molding process, is fitted with this associated rotary closure, which in the example shown has snapping elements 11, which are formed by two cylinder wall portions 10, and which each extend through almost 180° and, when the rotary closure is attached onto the neck 3, enclose the collar 4 thereof. The lower peripheries of the cylinder wall portions 10 form an inwardly projecting bead, which acts as a snapping element 11. Consequently, the rotary closure can be pressed onto the neck 3 of the container. During the pressing on, the two approximately semi-cylindrical cylinder wall portions 10 engage around the collar 4 at its thickest locations and finally snap their radially inwardly protruding beads 11 in at the lower periphery of the collar 4 and clamp the rotary closure onto the neck downwardly from above. The function of the two tube portions 6, 7 thereby takes effect. The outer side of the longer tube portion 6 with the smaller diameter hugs the inner wall of the neck 3 in a sealing manner and forms a seal almost all around. Only at the location where this inner tube portion 6 forms an aperture 8 does the neck inner wall remain uncovered, but is nevertheless covered there by the reduced wall height of the tube portion. As long as this aperture 8 does not lie in a pivoted position, in which it lies opposite the pouring channel 2, the rotary closure reliably seals off the container. The outer, less long tube portion 7 lies with its end face on the end face 1 of the neck 3 and forms a further seal. This seal is always effective, no matter in which rotary position the rotary closure is located. If then, however, the rotary closure is turned out of its closed position, in which the clearance 8 does not lie opposite the pouring channel 2, in the counterclockwise sense when seen from above, that is to say in the opening direction, the clearance 8 is pivoted and is finally located opposite the pouring channel 2. Then, however, liquid can flow from the pouring channel 2 through the clearance 8 into the region between the two tube portions 6, 7, and it can finally flow through the hole 9 in the lid surface 12 to the outside. For closing, the rotary closure is simply pivoted again in the clockwise sense or in the closing direction by a few angular degrees, until it comes up against the radial shoulders on the neck 3. In this position, it again reliably seals off the container. These stops on the radial surfaces 5 on the neck are acted upon by ribs 14, which are integrally formed on the inner side of the semi-cylindrical cylinder wall portions 10 and extend radially inward.

It is conducive to the operating convenience and also to the esthetic appearance if, as previously described, the rotary closure has an overcap 13, which has a downwardly diverging wall, which has its periphery in line with the outer contour of the bottle on which it is to be fitted. The lower periphery of the overcap 13 may also be of a curved design, in order that it replicates a matching shoulder contour of the bottle or of the container. This cover cap or overcap 13 is integrally formed outside the snapping elements 11 and is connected by means of a number of webs to the outer side of the cylinder wall portions 10, and furthermore the side walls or the circumferential wall of the overcap 13 lead seamlessly into the cap lid 12. In the example shown, the webs 18 are radial webs 18, which extend between the circumferential ends of the semi-cylindrical cylinder portions 10 radially outward up to the inner wall of the rotary closure overcap 13.

Figure 3:
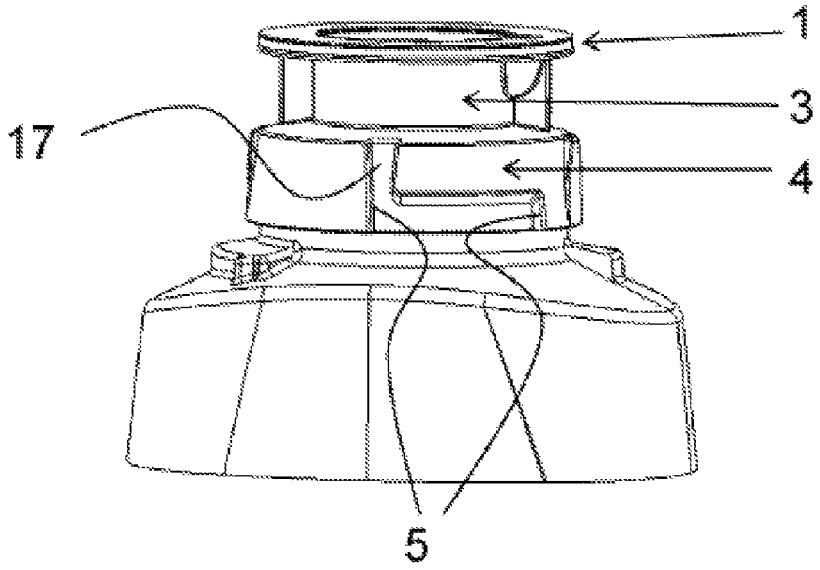
FIG. 3 shows the neck of the plastic container seen in a view from the side.

FIG. 3 shows this specific neck 3 of the container in a side view. In order that the rotary closure can be pressed onto the neck, the latter has in the outer wall of the collar 4 grooves 17 running in the axial direction, so that in an assembly position the ribs 14 on the rotary closure come to lie exactly above the grooves 17, and therefore the rotary closure can be pressed axially onto the neck 3. As soon as the ribs 14 have slid through the grooves 17, they act only for limiting the pivoting angle of the rotary closure on the neck and at both ends of the pivoting path butt against the radial surfaces 5 there on the collar 4 of the neck 3. With its semi-cylindrical cylinder wall portions 10 with their inwardly protruding beads 11, the rotary closure is thereby locked in under the collar 4 and held on the neck 3 in the axial direction.

It can then only be pivoted over the defined pivoting path between the closed position and the open position. Consequently, the entire solution can be produced merely from two very inexpensively producible injection-molded or blow-molded parts and the assembly operation takes an easy form, just comprising pressing the rotary closure axially onto the container neck. This makes this combination of the container or bottle with the associated rotary closure particularly inexpensive, but the closure solution nevertheless functions convincingly and is foolproof and convenient to operate.

Figure 4:
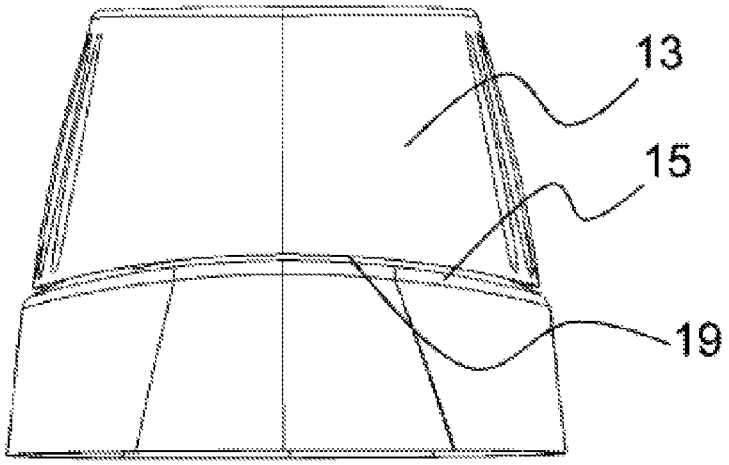
FIG. 4 shows the upper region of a container with an attached rotary closure in a view with the rotary closure in the closed position.
Figure 5:
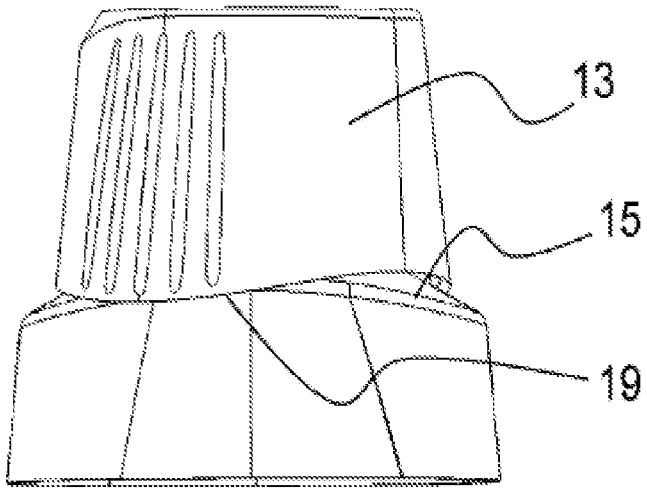
FIG. 5 shows the upper region of a container with an attached rotary closure in a view with the rotary closure in the open position.

As in the example according to FIGS. 4 and 5, the container has in its upper region a shoulder 15 that is curved in at least one direction. The associated rotary closure then finishes off in the downward direction with a rotary closure overcap 13, the periphery 19 of which replicates the contour of this shoulder 15 in the closed position of the rotary closure. This can be seen in FIG. 4, which shows this upper region of the container with the attached rotary closure in the closed position in a side view. In FIG. 5, the rotary closure can be seen in the open position. The lower periphery 19 of the rotary closure overcap 13 is then no longer congruent with the shoulder 15 on the container.

The invention claimed is:

1. A plastic container comprising a container body and an associated rotary closure in the form of a cap with a cap lid that can be pivoted about a central axis between an open position and a closed position, wherein the container body has a neck having a tubular upper end portion and a lower portion which forms on its outside a radially protruding collar, on the lower periphery of which the rotary closure can be locked in by snapping elements, so that said rotary closure is held on the neck pivotably about the central axis, wherein the collar also forms radial surfaces, which act as stop surfaces for radial ribs on an inner side of the associated rotary closure for limiting a pivoting range between the closed position and the open position of the rotary closure on the neck, further in that a mouth of the neck upper end portion forms an annular end face, into which there leads an open channel that is formed on a section of an inner side of the neck by bulging out from the neck in a radial direction and which is open toward the inner and upper side of the neck, wherein the rotary closure has on an inner side surface of its cap lid at least one outer tube section and a coaxially inner tube section extending therefrom, wherein an annular inner surface of the cap lid between inner and the outer tube sections lies in a sealing manner on the annular end face of the neck when the rotary closure is attached, and the inner tube section extends into the neck interior while lying in a sealing manner against the correspondingly formed neck inner wall and has at one location an aperture, wherein the annular inner surface of the cap has a hole formed therethrough at the location of the aperture, so that the aperture can be brought over the location of the bulging channel for the open position, in which state liquid can flow through the aperture and the bulging channel to exit through the hole in axial direction in relation to the rotary closure to the outside, whereas in the closed position the inner tube section covers over the bulging channel in the neck in a sealing manner.

2. The plastic container as claimed in claim 1, wherein the container body with its neck on the one hand and the associated rotary closure on the other hand consists of a single part in each case.

3. The plastic container as claimed in claim 1, wherein the rotary closure can be pressed onto the neck of the container body, after which it locks in on the neck by way of snapping elements formed thereon and is securely held in the axial direction, but is pivotable between the open position and the closed position.

4. The plastic container as claimed in claim 1, wherein the mouth of the neck of the container body forms a circular-ring-shaped end face projecting radially outward on it, wherein the outer tube section lies in a sealing manner on this end face when the rotary closure is attached.

5. The plastic container as claimed in claim 1, wherein snapping elements on the rotary closure are formed by two cylinder wall portions, which each extend around almost 180° and, when the rotary closure is attached onto the neck, enclose the collar thereof, wherein the lower peripheries of the inner and outer tubular sections form an inwardly projecting bead.

6. The plastic container as claimed in claim 1, wherein the rotary closure forms outside the snapping elements a rotary closure overcap, which is connected by a number of radial webs to the inner and outer tubular sections and are connected at the top to the cap lid.

7. The plastic container as claimed in claim 1, wherein the container has a shoulder that is curved in at least one direction, and in that the associated rotary closure has a rotary closure overcap with a lower outer edge, which replicates a contour of the shoulder in the closed position of the rotary closure.

8. The plastic container as claimed in claim 2, wherein the rotary closure can be pressed onto the neck of the container, after which it locks in on the neck by way of snapping elements and a bead and is securely held in the axial direction, but is pivotable between the open position and the closed position.

9. The plastic container as claimed in claim 2, wherein snapping elements on the rotary closure are formed by two cylinder wall portions, which each extend around almost 180° and, when the rotary closure is attached onto the neck, the inner and outer tubular sections enclose the collar on the neck, wherein lower outer edges of inner and outer tubular sections form an inwardly projecting bead.

10. The plastic container as claimed in claim 2, wherein the rotary closure forms outside the snapping elements a rotary closure overcap, which is connected by a number of webs to the inner and outer tubular sections and is connected at their top to the cap lid.

11. The plastic container as claimed in claim 2, wherein the container has a shoulder that is curved in at least one direction, and in that the associated rotary closure has a rotary closure overcap with a lower edge or periphery, which replicates a contour of the shoulder in the closed position of the rotary closure.

* * * * *